US009957793B2

(12) United States Patent
Allen et al.

(10) Patent No.: US 9,957,793 B2
(45) Date of Patent: May 1, 2018

(54) WELLBORE COMPLETION ASSEMBLY WITH REAL-TIME DATA COMMUNICATION APPARATUS

(71) Applicants: Jason Allen, Houston, TX (US); Kelly Ireland, The Woodlands, TX (US); Colin Andrew, Brampton (CA); Philippe Legrand, The Woodlands, TX (US); Tommy Kirkpatrick, New Caney, TX (US); Jason Barnard, Katy, TX (US)

(72) Inventors: Jason Allen, Houston, TX (US); Kelly Ireland, The Woodlands, TX (US); Colin Andrew, Brampton (CA); Philippe Legrand, The Woodlands, TX (US); Tommy Kirkpatrick, New Caney, TX (US); Jason Barnard, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 280 days.

(21) Appl. No.: 14/549,447

(22) Filed: Nov. 20, 2014

(65) Prior Publication Data

US 2016/0145972 A1 May 26, 2016

(51) Int. Cl.

| | |
|---|---|
| ***E21B 47/01*** | (2012.01) |
| ***E21B 34/14*** | (2006.01) |
| ***E21B 47/12*** | (2012.01) |
| ***E21B 47/06*** | (2012.01) |
| ***E21B 43/16*** | (2006.01) |
| ***E21B 43/08*** | (2006.01) |

(52) U.S. Cl.

CPC ..... *E21B 47/01* (2013.01); *E21B 34/14* (2013.01); *E21B 43/08* (2013.01); *E21B 43/16* (2013.01); *E21B 47/06* (2013.01); *E21B 47/065* (2013.01); *E21B 47/12* (2013.01)

(58) Field of Classification Search

CPC ..... E21B 43/082; E21B 34/14; E21B 47/01; E21B 47/12; E21B 47/06; E21B 44/005; E21B 43/16; E21B 43/08; E21B 47/065

See application file for complete search history.

(56) References Cited

U.S. PATENT DOCUMENTS

2007/0227727 A1* 10/2007 Patel ..... E21B 17/028 166/250.01

2009/0065206 A1* 3/2009 Russell ..... E21B 43/082 166/276

* cited by examiner

*Primary Examiner* — Brad Harcourt

(74) *Attorney, Agent, or Firm* — Cantor Colburn LLP

(57) ABSTRACT

In one aspect an apparatus for use in a wellbore is disclosed that in one non-limiting embodiment includes a completion assembly that contains a filter section having a tubular with a plurality of through holes filled with a filter material for restricting flow of solid particles through the holes for placement of the filter section across from a zone along the wellbore, a sensor inside the tubular for providing information about a parameter of interest during treatment of and/or production from the zone into the tubular, and a first circuit coupled to the sensor that transmits wireless signals corresponding to measurements made by the sensor to a second circuit that transmits the received signals to the surface.

20 Claims, 2 Drawing Sheets

WELLBORE COMPLETION ASSEMBLY WITH REAL-TIME DATA COMMUNICATION APPARATUS

BACKGROUND

1. Field of the Disclosure

This disclosure relates generally to real-time monitoring and control of treatment of formation zones and production of hydrocarbons therefrom.

2. Background of the Art

Wellbores are drilled for the production of hydrocarbons (oil and gas) from traps or zones in subsurface formations at different wellbore depths. Such zones are also referred to as reservoirs or hydrocarbon-bearing formations or production zones. A casing is generally placed inside the wellbore and the space between the casing and the wellbore (annulus) is filled with cement. A completion string or assembly containing a number of devices is placed inside the casing to perform a variety of operations downhole, including, but not limited to, fracturing and packing zones, gravel packing and flooding zones with fluids supplied from the surface. Typically, the completion assembly includes an outer assembly and an inner or service assembly placed inside the outer assembly. The outer assembly typically contains packers to isolate zones, flow control devices to provide fluid communication between inside of the outer assembly and the formation, sand screens for preventing or mitigating flow of solid particles above a certain size from the formation to the inside of the outer string. The inner assembly typically contains devices to open and close or operate flow control devices or valves in the outer assembly and to provide a fluid path from the surface to the outer assembly. To treat a zone, the treatment fluid or slurry is supplied to the inside of the inner assembly, which is supplied to the formation via a port in the inner assembly and another port in the outer assembly. After a treatment operation, the inner string is pulled out from the wellbore and the wellbore is made ready for the production of hydrocarbons from the various zones. It is desirable to place sensors downhole close to the flow of the fluids to and from the zones that frac such zones to monitor treatment operations and to subsequently monitor production of the hydrocarbons from such zones without encroaching into the space between the outer string and the casing or the well bore.

The disclosure herein provides apparatus and methods for real-time monitoring and control of downhole operations, including treatment and production operations utilizing sensors in a sand screen tubing.

SUMMARY

In one aspect an apparatus for use in a wellbore is disclosed that in one non-limiting embodiment includes a completion assembly that contains a member having a plurality of holes filled with a filter material for placement across from a zone along the wellbore, a sensor inside the tubular for providing information about a parameter of interest during treatment of and/or production of a fluid from the zone into the tubular, and a circuit downhole coupled to the sensor that transmits wireless signals corresponding to measurements made by the sensor for processing and for taking actions relating to downhole operations.

In another aspect, a method completing a wellbore is disclosed that includes: placing a completion assembly in the wellbore that includes member across from a selected zone, the member a plurality of through holes that contain a filter material and a sensor in the member that provides measurements about a parameter of interest, and a circuit that transmits wireless signals responsive to the measurements of the sensor for determining the parameter of interest during a downhole operation; an controlling an aspect of the downhole operation based at least in part on the determined parameter of interest.

Examples of the more important features of the apparatus and methods disclosed herein are summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
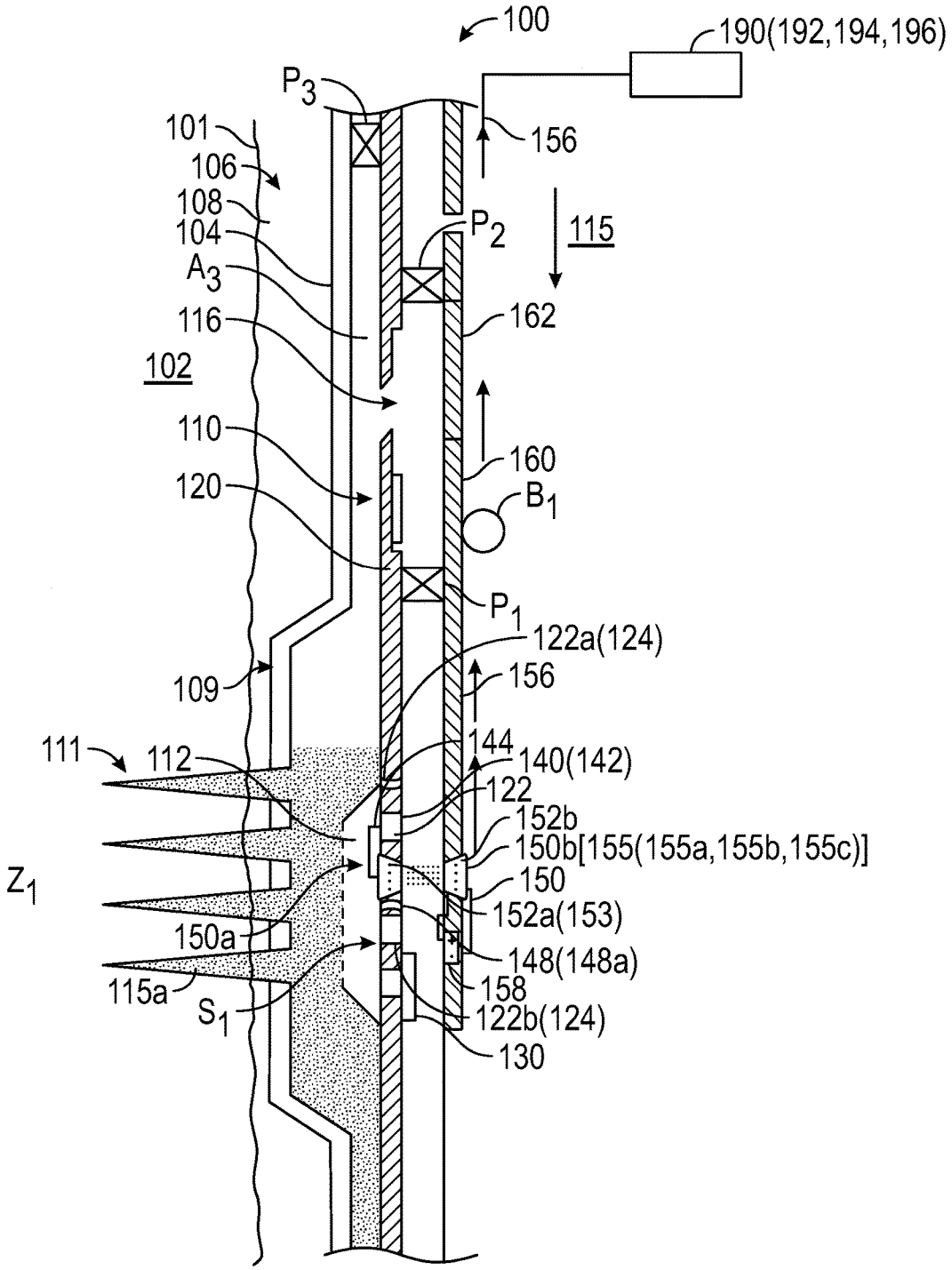
FIG. 1 shows a completion assembly placed in a wellbore that includes an outer assembly and an inner assembly to provide data communication between a section of the outer assembly and a remote location during a treatment operation of a zone of the formation along the wellbore, according to one non-limiting embodiment of the disclosure.

FIG. 1 shows a wellbore system 100 that includes a wellbore 101 formed through a formation 102. For simplicity, the wellbore 101 is shown to include a single zone $Z_1$ for treatment, such as fracturing and sand packing, gravel packing or flooding. The wellbore 101 is lined with a casing 104 and the annulus 106 between the wellbore 101 and the casing 104 is filled with cement 108. Although the wellbore system 100 is shown as a cased-hole system, the apparatus and methods described herein may equally be utilized in non-cased holes, i.e., open holes. In the particular embodiment of FIG. 1, the casing 104 is shown to include an expanded section 109 across from the zone $Z_1$. Other embodiments may include none or more than one expanded sections. The zone $Z_1$ includes perforations 111 that run from inside the casing 104 into the zone $Z_1$. The apparatus shown in the wellbore 101 includes an outer assembly 110 (also referred to as the "completion assembly") that includes a tubular member 120 that includes a number of through holes, such as 122*a*, 122*b*, etc. Such holes include suitable porous material 124 that prevents or restricts the flow of solid particles, such as formation rock particles or proppant from a treatment fluid, into the tubing 120. In other embodiments, a number of tubulars, each including a number of filter material filled holes may be axially connected with a fluid flow path between successive tubulars to form a relatively long filter member (for example 500 feet or longer) In the embodiment of FIG. 1, tubing section $S_1$ containing the filter filled holes 122*a*, 122*b*, etc., is placed across from zone Z1. One or more sensors 140 is placed inside a hole or cavity 122*s* inside the member 120. A single or multiple sensors may be utilized for more than one serially connected section, such as section $S_1$. A protective member, such as a shroud 112, may be provided on the outside of the section $S_1$ to protect the sensors 140 and other sensitive components in the tubular 120. A common protective member may be placed along all serially connected filter filled sections. A common electrical circuit, such as circuit 150 described below, may be utilized to process and transmit sensor signals. The protective member 112 protects the sensors 140 and the circuit 150 from impact of the flow of the fluids and solid particles from the formation 102 and the treatment fluid. In one non-limiting embodiment, removable or dissolvable protective member or materials may be placed on the filter material that provides a pressure barrier along the filter section $S_1$ during treatment operation and then dissolves due to the downhole conditions or is dissolved, such as by applying an accelerant, such as heat, acid or another material, to the such protective members prior to the production hydrocarbon from the formation 102.

Still referring to FIG. 1, the system 100 includes a circuit 150 for processing sensor measurements and providing a two-way communication with a controller 190 at the surface. In one non-limiting embodiment, circuit 150 includes a first circuit 150*a* coupled to the sensor 140 receives the signals from the sensor 140 and may condition and process such signals. In one embodiment, the circuit 150*a* may be embedded inside a cavity 153 in the tubing 120 and coupled to the sensor 140 via a suitable conductor or link 144. In another embodiment, circuit 150*a* may be placed along the outside or inside of the tubular. In one embodiment, a common circuit 150*a* may be utilized for one or more sensors along a single or multiple serially connected filter sections. In one embodiment, circuit 150*a* includes a coil 152*a* for providing inductive coupling for transmission of data and signals from the circuit 150*a* relating to the measurements of the sensor 140. A power source 148, such as a battery, may be placed in a cavity 148*a* in the tubing 120. The circuit 150 further includes a circuit 150*b* that contains a coil 152*b* and a power source 158. The circuit 150*b* may further include a control unit or controller 155 that may include a processor 155*a*, a memory device 155*b* and programmed instruction 155*c* accessible to the processor 155*a* to process sensor 140 signals received from circuit 150*a* and transmit data provide communication with the surface controller 190 via a link 156. The link 156 may be any suitable available link, including, but not limited to, an electrical conductor, a fiber optic link or a wireless data transmission link, such as a link utilizing electromagnetic telemetry. The controller 190 may be a computer-based system that includes a processor 192 for processing data received from downhole circuit 150, a data storage device 194 for storing data and programmed instructions 196 accessible to the processor 192. The power source 158 may provide power to the circuit 150*a* and or charge the power source 148. Thus, in one non-limiting embodiment, the system 100 includes at least one sensor in a sand screen-based tubular or pipe that provides information relating to one or more parameters of interest from the outside of the pipe. In one non-limiting embodiment, a circuit 150 is provided in the sand-based pipe for inductively providing sensor information for further processing and transmission to a surface controller 190 via a link 190. The sensors 140 and the circuit 150*a* may be embedded or placed inside sand-screen tubular for protection from the flow of fluids in the formation zones. The sensors are in the flow path of the fluid flowing into or out of the sand screen S1 and thus provide real time information about the parameters relating to the flow of the fluids into the treatment zones and fluid flowing from the formation 102 during production of such fluids.

Still referring to FIG. 1, for treating zone $Z_1$, an inner string 160 is conveyed into the wellbore along with the outer string 120. In one non-limiting embodiment, the inner string 160 includes a frac port 162 and the outer string 110 includes a frac sleeve 116, such as sliding sleeve valve. For treatment operations, the sand screen $S_1$ is across from the zone Z1 and the frac port 162 is aligned with the frac sleeve 116. Packers $P_1$ and $P_2$ are set to isolate a section or annulus A1 above and below the frac sleeve 116. Packer $P_3$ between the outer string 110 and the inner string 160 prevents flow of a fluid through the annulus $A_2$ to the surface 105. A ball B1 may be dropped and set at a location below the frac port 162 and above the screen $S_1$ to prevent flow of a treatment fluid 115 below the ball B1. The treatment fluid 115, which may be slurry containing water, additives including guar, and proppant 115*a*, such as sand or synthetic beads, is pumped into the inner string 160 from the surface 105. The slurry 115 flows into the perforations 111 in the casing 104 via the frac port 162 and frac sleeve 116 and then into the rock in zone $Z_1$ to fracture the rock. The cracks are filled with the proppant 115*a*. A majority of the water in the slurry 115 is injected into the zone $Z_1$ and a relatively small amount of the water from the slurry 115 returns to the inside of the screen $S_1$ via a monitoring valve 130.

During the treatment operation, the sensors 140 provide measurements of one or more downhole parameters, including, but not limited to, pressure, temperature, and flow rate. The data from the sensors 140 may be conditioned by circuit 150*a* and transmitted by the coil 152*a* to the coil 152*b*. The controller 155 may process the received signals are transmit data to the controller 190 via link 156. An operator at the surface and/or controller 190 may take one or more actions to control the treatment operations, including, but not limited to, controlling the flow rate of the slurry and proportions of the constituents of the slurry 115. The sensors 140, circuit 150*a* and the link 144 placed inside the tubing of the sand screen $S_1$ remain protected from the harsh environment and abrasive nature of the flow of the slurry 115. The circuit 150 along with the sensors 140 provides real-time information about downhole parameters during a treatment operation during production and enable an operator and/or a controller to control such an operation.

Figure 2:
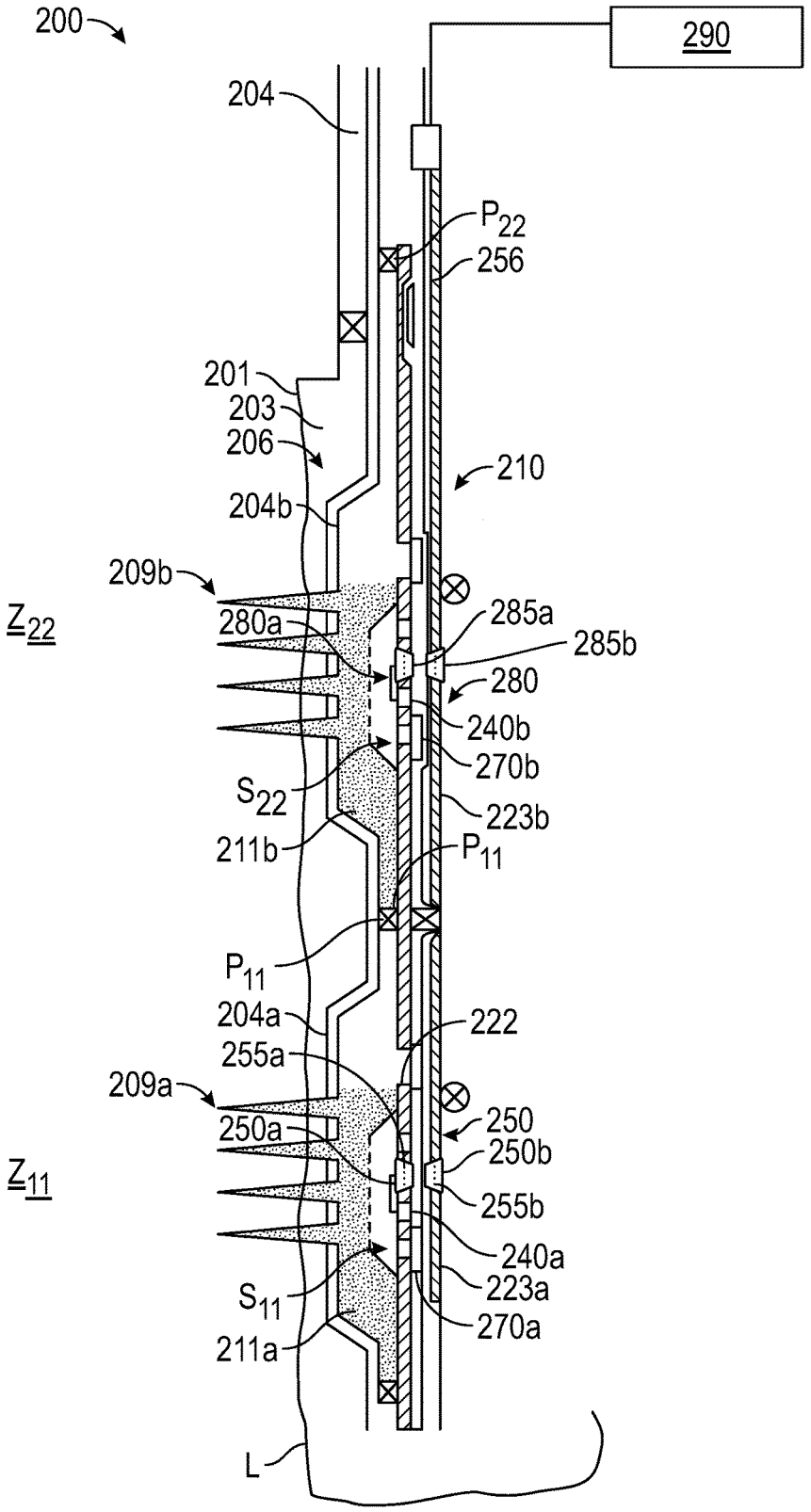
FIG. 2 shows an outer assembly made in a manner shown in FIG. 1 to provide data communication between a number of zones and a remote location during production of fluids from the zones into the wellbore.

FIG. 2 shows a multi-zone production system 200 for real time communication utilizing the circuits and sensors descried in reference to FIG. 1. The system 200 includes a wellbore 201 that contains a completion assembly made according to a non-limiting embodiment shown in FIG. 1. The wellbore 201 is formed in a formation 202 and includes a lower production zone $Z_{11}$ and an upper production zone $Z_{22}$. A casing 204 is placed along the inside of the wellbore 201 with an expanded section 204*a* across from zone $Z_{11}$ and an expanded section 204*b* across from zone $Z_{22}$. The annulus 203 is filled with cement 206. A completion assembly 210 is placed inside the casing 204, wherein a lower filter section $S_{11}$ is placed across from zone $Z_{11}$ and an upper filter section $S_{22}$ is placed across from zone $Z_{22}$. In FIG. 2, zones $Z_{11}$ is shown fractured via perforation 209*a* and packed with a proppant 211*a* while zone $Z_{22}$ is fractured via perforations 209*b* and packed with proppant 211*b*. Packers $P_{11}$ and $P_{22}$ respectively isolate zones $Z_{11}$ and $Z_{22}$ from each other. As noted above, filter sections $S_{11}$ and $S_{22}$ may include multiple serially-connected sections with fluid flow along adjacent sections and a common circuit connected to sensors in such sections.

Still referring to FIG. 2, filter $S_{11}$ contains at least one sensor 240*a* in a hole or cavity in a tubular member 222 of filter $S_{11}$. A circuit 250 processes the signals from sensors 240 and communicates with a controller 290 at the surface. The circuit 250 includes a circuit 250*a* coupled to the sensor 240*a* to condition sensor measurements and transmit information via an inductive coil 255*a* to an inductive coil 255*b* in a circuit 250*b* on the tubular 223*a*. Similarly, at least one sensor 240*b* is placed in a cavity or hole in a tubular member 222_of filter $S_{22}$. A circuit 280 in the filter $S_{11}$ includes circuits to condition signals from sensor 240*b* and transmit the sensor data via a coil 285*a* to a coil 285*b* on the tubular 223*b* of circuit 280*b*. Circuits 250*b* and 280*b* are in data and power communication with a surface controller 290 via a communication link 256, such as a conductor, optical fibers or a wireless device.

During production, valves 270*a* and 270*b* respectively control flow of fluids from zones $Z_{11}$ and $Z_{22}$. Valves 270*a* and 270*b* may be electrically-controlled valves by the controller 250. During production, sensors 240*a* and 240*b* respectively provide information about the downhole conditions and the fluids flowing from their associated or corresponding zones $Z_{11}$ and $Z_{22}$. Such information may include, but is not limited to. pressure, temperature, flow rate, a physical property of the fluids, such as density and viscosity, one or more chemical properties the fluids, and constituents of the fluid, such as oil, gas and water. In one embodiment, acoustic sensors are placed in the sand screens to provide information of water flooding from their corresponding zones into the wellbore. The data from the sensors is processed by the controller 290 and utilized by the controller and/or an operator to control production from the zones $Z_{11}$ and $Z_{22}$, including control of the valves 270*a*, 270*b* and to take remedial actions, such chemical injection and other desired operations.

The foregoing disclosure is directed to certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. An apparatus for use in a wellbore, comprising:

a completion assembly including a tubular that includes a plurality of through holes filled with a filter material to form a filter section that restricts flow of solid particles through such holes and a sensor in a through hole of the tubular for providing information about a parameter of interest during treatment of a zone or production of a fluid from the zone into the tubular;

a first circuit coupled to the sensor that transmits first signals corresponding to measurements made by the sensor, wherein the first signals are wireless signals;

a second circuit spaced from the first circuit on a member placed inside the tubular to receive the first signals; and a communication link between the second circuit and a surface location that transmits second signals responsive to the first signals to the surface location.

2. The apparatus of claim 1, wherein the first circuit and the second circuit form an inductive coupling for transmission and reception of the first signals.

3. The apparatus of claim 2, wherein the second circuit provides electrical energy to the first circuit via the inductive coupling.

4. The apparatus of claim 1 further comprising a protective screen between the filter section and the wellbore.

5. The apparatus of claim 4, wherein the filter section includes a plurality of serially connected pipe sections with a fluid flow path between adjoining pipe sections and wherein each such pipe section includes a plurality of filter material-filled through holes and a sensor and wherein the first circuit is common to the sensors in such pipe sections.

6. The apparatus of claim 1, wherein each hole in the plurality of through holes containing the filter material includes a dissolvable material that provides a pressure barrier for each such hole during a treatment operation and dissolves subsequent to the treatment operation to provide a fluid flow path through each such hole.

7. The apparatus of claim 1, wherein the filter section includes a sliding sleeve that provides one of: a flow path for treating a zone across the filter section; and a flow path for a fluid from a zone across from the filter section into the tubular.

8. The apparatus of claim 1, wherein the tubular is an outer assembly deployable in the wellbore and the member is an inner assembly configured to supply a treatment fluid to an annulus between the tubular and the wellbore to treat the zone.

9. The apparatus of claim 1, wherein the sensor provides measurements selected from a group consisting of: pressure, temperature, flow rate, constituent of a fluid, and water content.

10. The apparatus of claim 1 further comprising a controller that controls flow of a fluid from the zone into the wellbore in response to measurements from the sensor.

11. A method of completing a wellbore, comprising:

placing a completion assembly in the wellbore that includes a filter section across from a zone, the filter section including:

a tubular that includes a plurality of through holes filled with a material that restricts flow of solid particles through such holes and a sensor inside a through hole of the tubular that provides measurements relating to a parameter of interest during a downhole operation relating to the zone, and a first circuit that transmits wireless signals responsive to the measurements by the sensor, and a member inside the tubular, the member having a second circuit that receives the wireless signals from the first circuit and transmits signals responsive to the received signals to a surface location;

performing the downhole operation relating to the zone; and determining the parameter of interest from signals transmitted by the first circuit during the downhole operation.

12. The method of claim 11 further comprising isolating the zone, wherein the downhole operation includes treating the zone with a treatment fluid and wherein the parameter of interest relates to flow of the treatment fluid.

13. The method of claim 12 further comprising controlling the treatment operation in response to the determined parameter of interest.

14. The method of claim 11 further comprising producing a formation fluid from the zone through the filter section, wherein the parameter of interest relates to flow of a formation fluid into the filter section.

15. The method of claim 11, wherein the first circuit and the second circuit comprise an inductive coupling for transmission of signals from the sensor to a surface location.

16. The method of claim 11, wherein the parameter of interest is selected from a group consisting of: pressure; temperature; flow rate; a constituent of a fluid; water content; and water flooding.

17. The method of claim 11 further comprising providing a protective screen between the filter section and the zone.

18. The method of claim 11, wherein the filter section includes a plurality of serially connected pipe sections with a fluid flow path between adjoining pipe sections and wherein each such pipe section includes a plurality of filter material-filled through holes and a sensor and wherein the circuit is common to the sensors in such pipe sections.

19. The method of claim 11 further comprising placing a dissolvable material on or in the filter material that provides a pressure barrier during the treatment operation and dissolves subsequent to the treatment operation to provide a fluid flow path through the filter material.

20. The method of claim 11 further comprising providing a sliding sleeve in the filter section to provide one of: a flow path for treating the zone; and a flow path for a fluid from the zone into the tubular.

* * * * *